US008683894B1

(12) United States Patent
Chen et al.

(10) Patent No.: US 8,683,894 B1
(45) Date of Patent: Apr. 1, 2014

(54) POSITIONING STRUCTURE FOR A RATCHET WRENCH

(71) Applicants: Yu Wen Chen, Taichung (TW); Tien Sung Chen, Taichung (TW)

(72) Inventors: Yu Wen Chen, Taichung (TW); Tien Sung Chen, Taichung (TW)

( * ) Notice: Subject to any disclaimer, the term of this patent is extended or adjusted under 35 U.S.C. 154(b) by 0 days.

(21) Appl. No.: 13/740,287

(22) Filed: Jan. 14, 2013

(51) Int. Cl.
*B25B 13/46* (2006.01)
*B25B 23/08* (2006.01)
*B25B 23/10* (2006.01)

(52) U.S. Cl.
USPC ..... 81/63.1; 81/62; 81/443

(58) Field of Classification Search
USPC ..... 81/62, 60, 63.1, 441–443, 446, 448
See application file for complete search history.

(56) References Cited

U.S. PATENT DOCUMENTS 6,964,216 B2 * 11/2005 Chen ..... 81/63.1
6,981,434 B2 * 1/2006 Chen ..... 81/63.1
7,444,902 B1 * 11/2008 Lin et al. ..... 81/57.29
7,975,574 B2 * 7/2011 Hu ..... 81/63.1
2005/0257650 A1 * 11/2005 Hu ..... 81/63.1
2006/0117913 A1 * 6/2006 Chen ..... 81/63.1

* cited by examiner

*Primary Examiner* — Monica Carter
*Assistant Examiner* — Danny Hong

(57) ABSTRACT

A positioning structure for a ratchet wrench contains a ratchet wrench including a driving head, a receiving cavity, a first groove, a second groove, and a hole. The receiving cavity has a driving member, and the driving member having a toothed portion. The first groove has two opposite retaining blocks each having a plurality of locking teeth so as to engage with the toothed portion and having an orifice and a receiving aperture, and between two receiving apertures is defined a first resilient element. The second groove has a directional control member mounted, and the directional control member has a limiting portion, a recessed portion, an actuation portion, and a shaft, wherein a second resilient element is fitted onto the shaft and is inserted into the hole of the second groove, and the actuation portion is inserted into two orifices of the two retaining blocks.

6 Claims, 15 Drawing Sheets

POSITIONING STRUCTURE FOR A RATCHET WRENCH

FIELD OF THE INVENTION

The present invention relates to a ratchet wrench, and more particularly to a positioning structure for the ratchet wrench.

BACKGROUND OF THE INVENTION

As shown in FIGS. 11-15, a conventional ratchet wrench 50 contains a driving head 51, a receiving cavity 52 defined in the driving head 51, a first groove 53 formed on a rear end of the receiving cavity 52 and communicating with the receiving cavity 52, a second groove 54 arranged on a rear end of the first groove 53 and communicating with the first groove 53, a first hole 55 and a second hole 56 defined in the second groove 54, a steel ball 57 fixed in the second hole 56. The receiving cavity 52 includes a driving member 60 received therein, and the driving member 60 has a toothed portion 61 arranged around an outer wall thereof. The first groove 53 has two opposite retaining blocks 70 mounted therein, and each retaining block 70 has a plurality of teeth 72 formed around a front end thereof so as to retain with the toothed portion 61 of the driving member 60. The each retaining block 70 has a post 71 extending upwardly from a top surface thereof, and between the two retaining blocks 70 is defined a resilient element 73. The second groove 54 has a directional control member 80 fixed therein, and the directional control member 80 has an actuation portion 81 mounted on a front end of a lower side thereof, a positioning shaft 82 disposed on a rear end thereof, and a limiting slot 83, wherein the positioning shaft 82 is inserted into the first hole 55 of the second groove 54 so as to form a rotating axis of the directional control member 80.

Thereby, when the directional control member 80 is rotated toward one of the two retaining blocks 70, it is fixed by the limiting slot 83 and the steel ball 57, and the actuation portion 81 hooks a post 71 of the one of the two retaining blocks 70 so that a plurality of teeth 72 of the one of the two retaining blocks 70 disengage from the toothed portion 61 of the driving member 60, and the resilient element 73 pushes another retaining block 70 to move forward so that the another retaining block 70 abuts against the driving member 60 further, thus changing an operational direction of the ratchet wrench 50.

However, such a conventional ratchet wrench 50 has the following defects:

1. The positioning structure is complicated to increase manufacture cost and time.

2. An operating space has to be kept on an overlap area of the first groove 53 and the second groove 54 as illustrated in FIG. 13, so a height of the retaining block 70 is decreased, thus lowering an engagement area of the each retaining block 70 and the plurality of teeth 72.

The present invention has arisen to mitigate and/or obviate the afore-described disadvantages.

SUMMARY OF THE INVENTION

The primary object of the present invention is to provide a positioning structure for a ratchet wrench in which a directional control member does not overlap with two retaining blocks in operation, so an engagement area of a plurality locking teeth and a working portion is increased to obtain a biggest torque force.

DETAILED DESCRIPTION OF THE PREFERRED EMBODIMENTS

Figure 1:
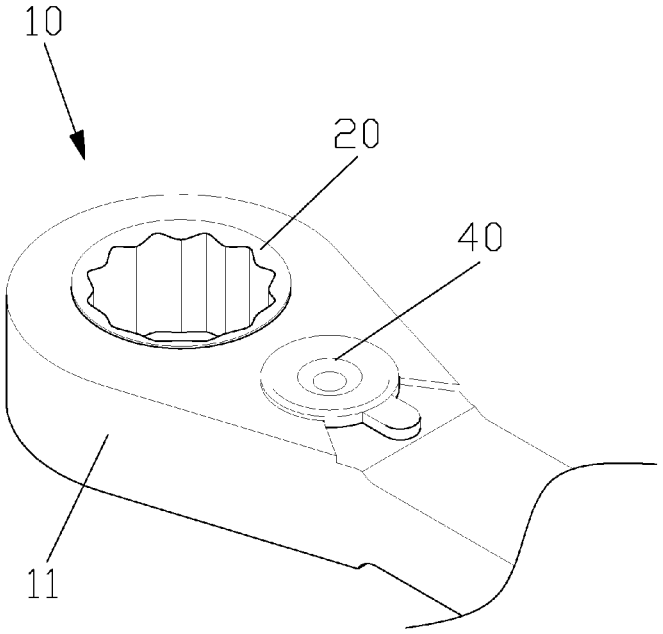
FIG. 1 is a perspective view showing the assembly of a positioning structure for a ratchet wrench according to a first embodiment of the present invention.
Figure 2:
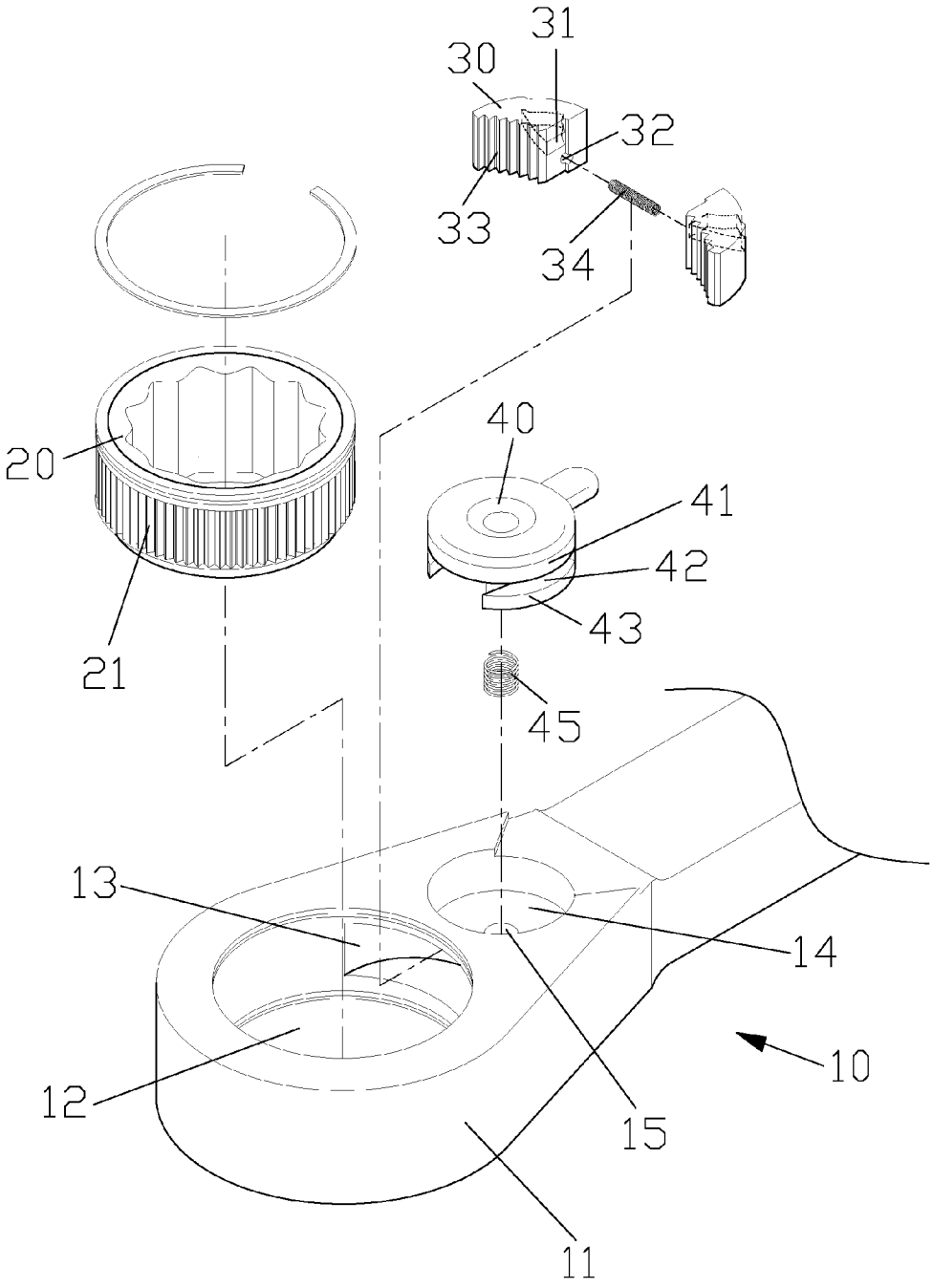
FIG. 2 is a perspective view showing the exploded components of the positioning structure for the ratchet wrench according to the first embodiment of the present invention.
Figure 3:
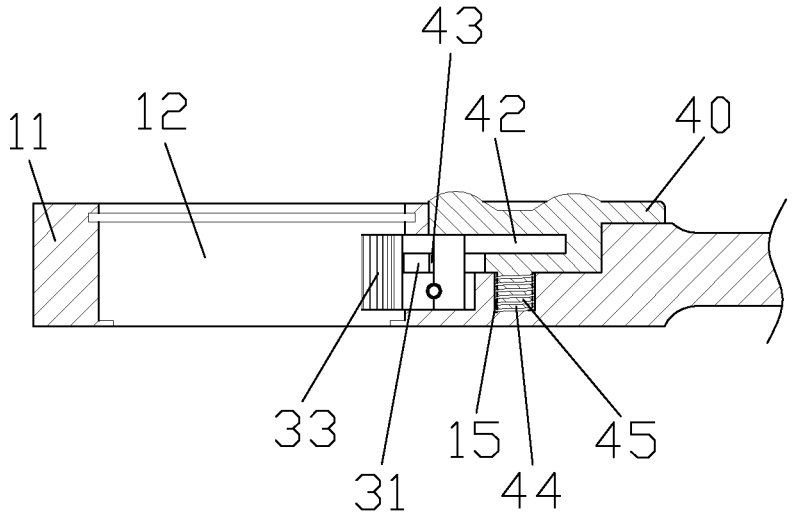
FIG. 3 is a cross sectional view showing the assembly of the positioning structure for the ratchet wrench according to the first embodiment of the present invention.
Figure 4:
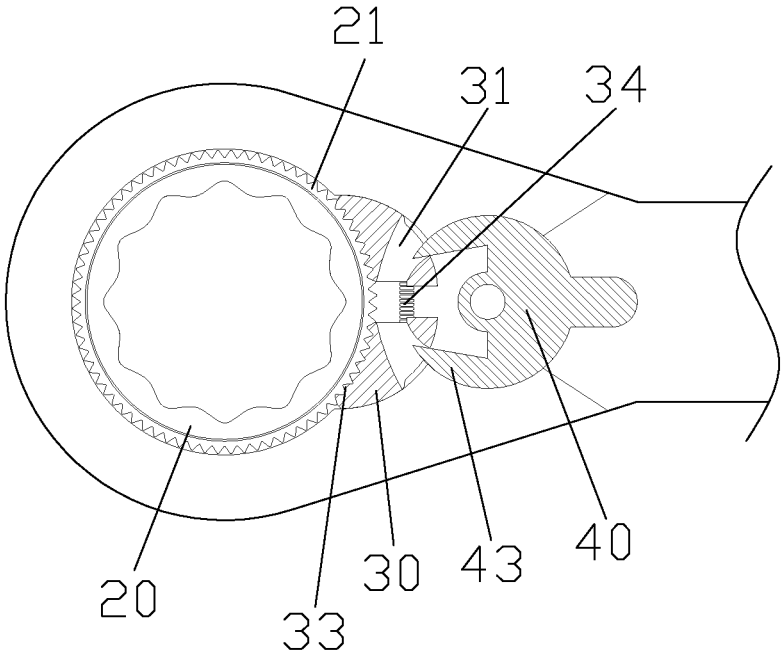
FIG. 4 is a cross sectional view showing the operation of the positioning structure for the ratchet wrench according to the first embodiment of the present invention.
Figure 5:
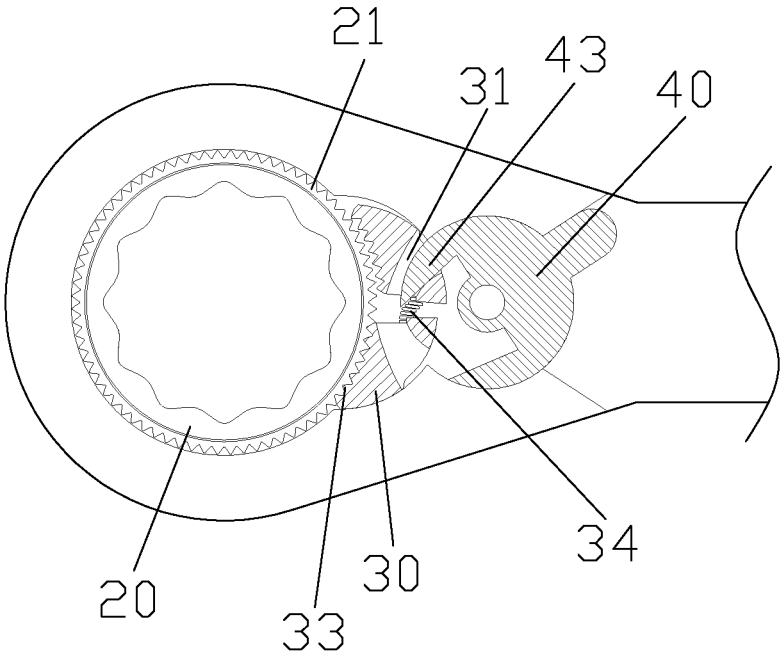
FIG. 5 is another cross sectional view showing the operation of the positioning structure for the ratchet wrench according to the first embodiment of the present invention.
Figure 6:
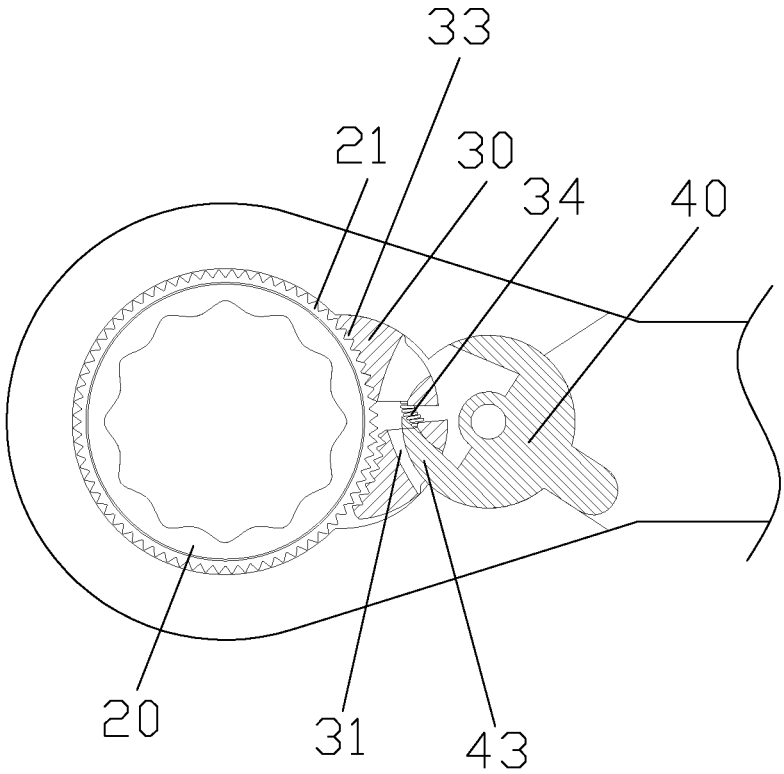
FIG. 6 is also another cross sectional view showing the operation of the positioning structure for the ratchet wrench according to the first embodiment of the present invention.
Figure 7:
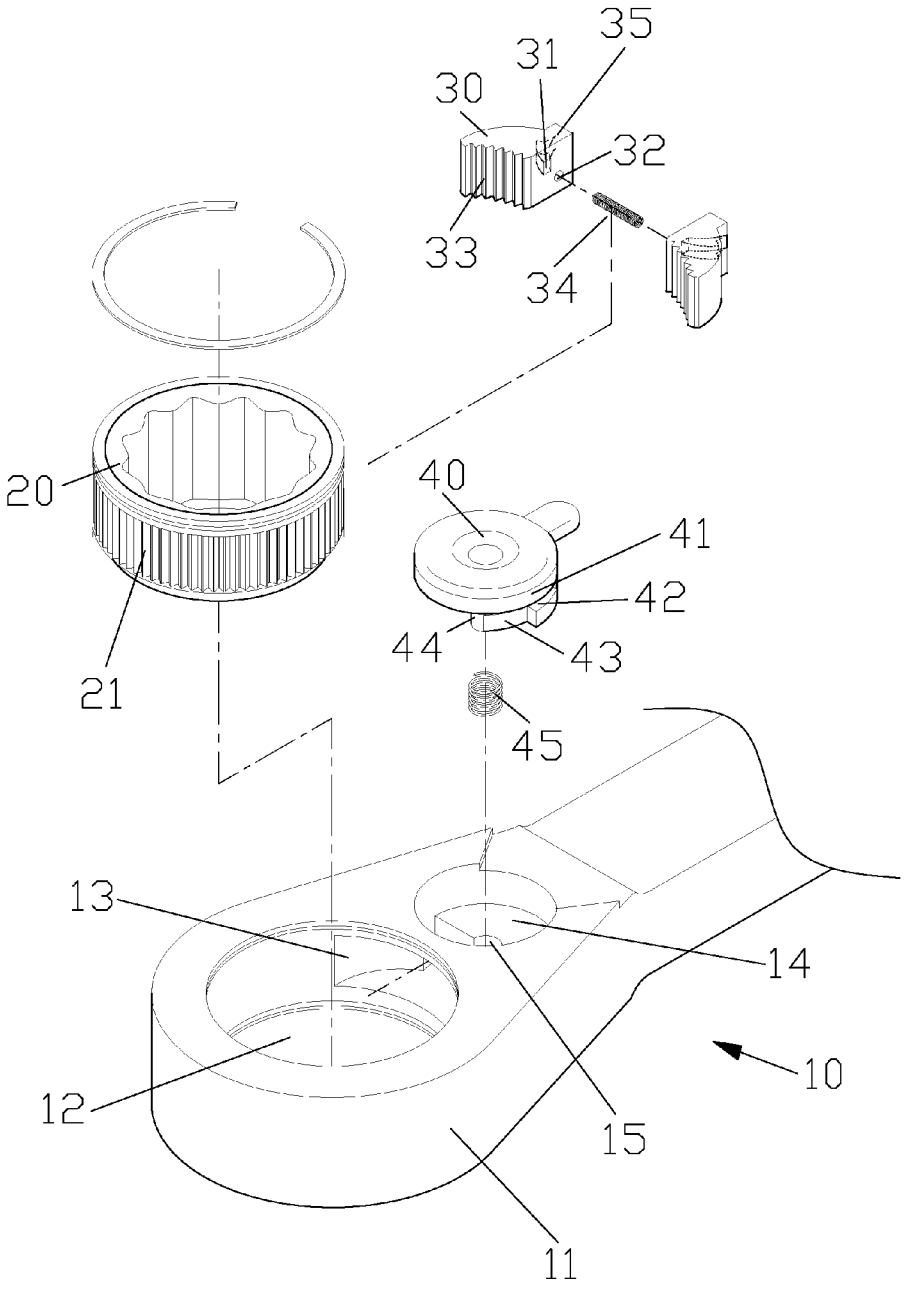
FIG. 7 is a perspective view showing the exploded components of the positioning structure for the ratchet wrench according to a second embodiment of the present invention.
Figure 8:
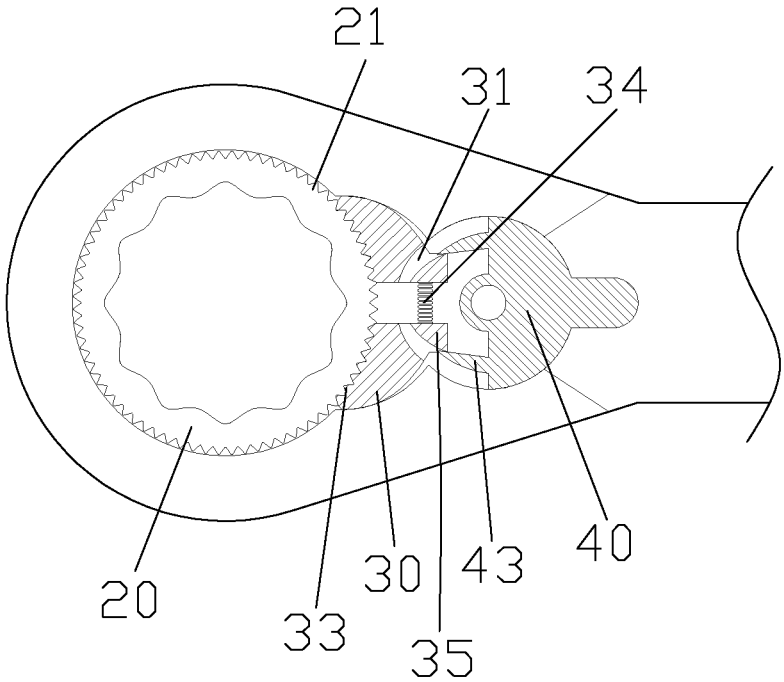
FIG. 8 is a cross sectional view showing the operation of the positioning structure for the ratchet wrench according to the second embodiment of the present invention.
Figure 9:
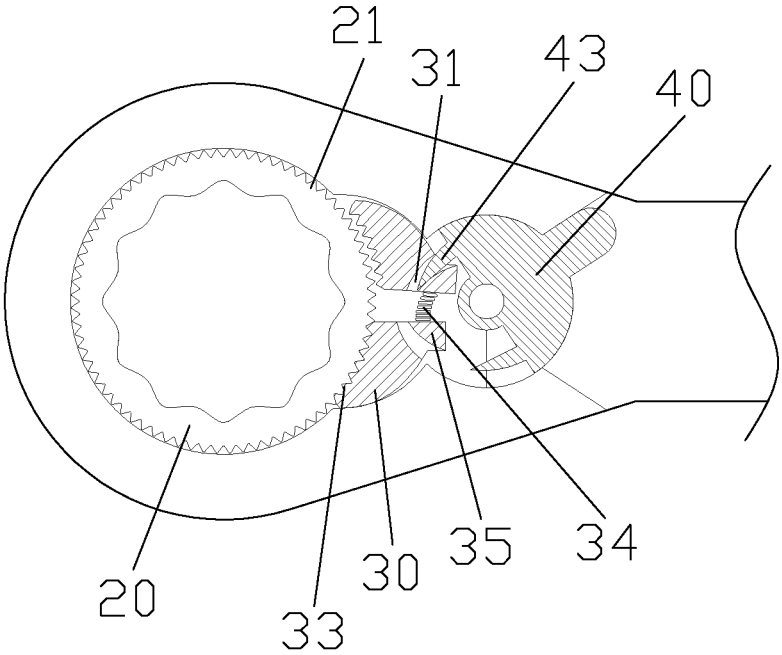
FIG. 9 is another cross sectional view showing the operation of the positioning structure for the ratchet wrench according to the second embodiment of the present invention.
Figure 10:
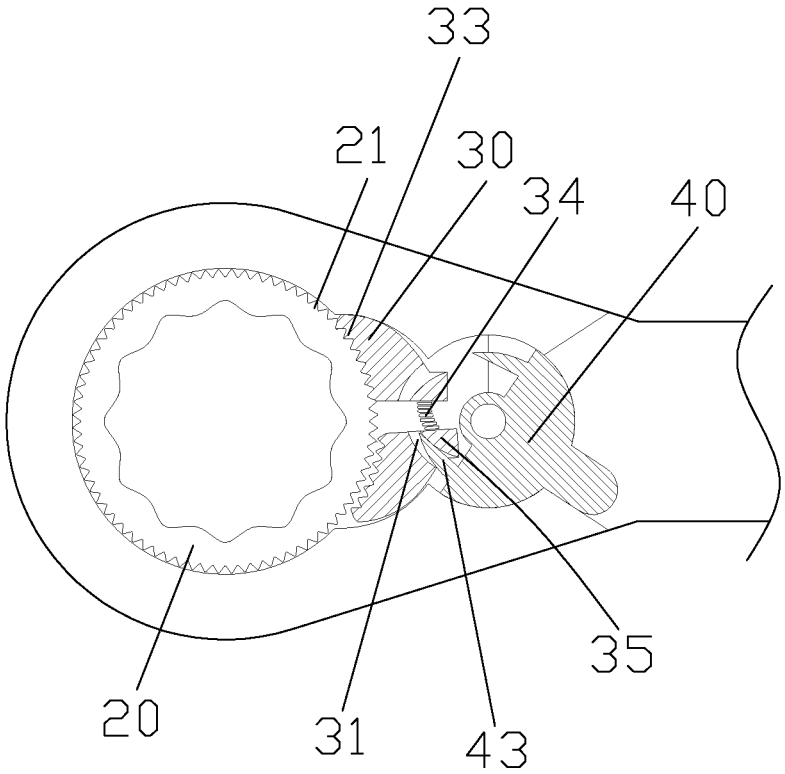
FIG. 10 is another cross sectional view showing the operation of the positioning structure for the ratchet wrench according to the second embodiment of the present invention.
Figure 11:
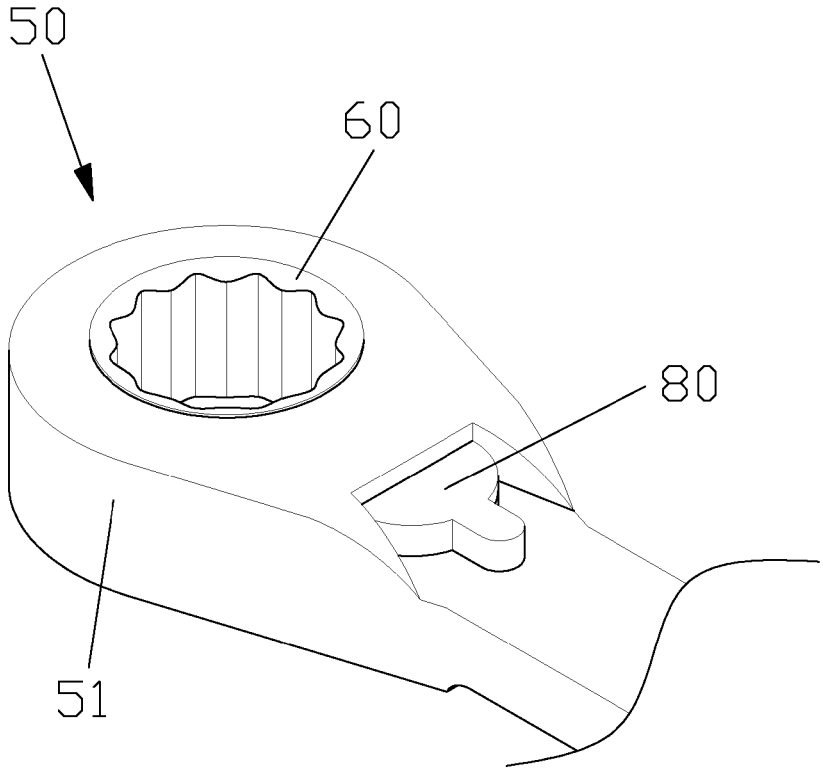
FIG. 11 is a perspective view showing the assembly of a conventional positioning structure for a ratchet wrench.
Figure 12:
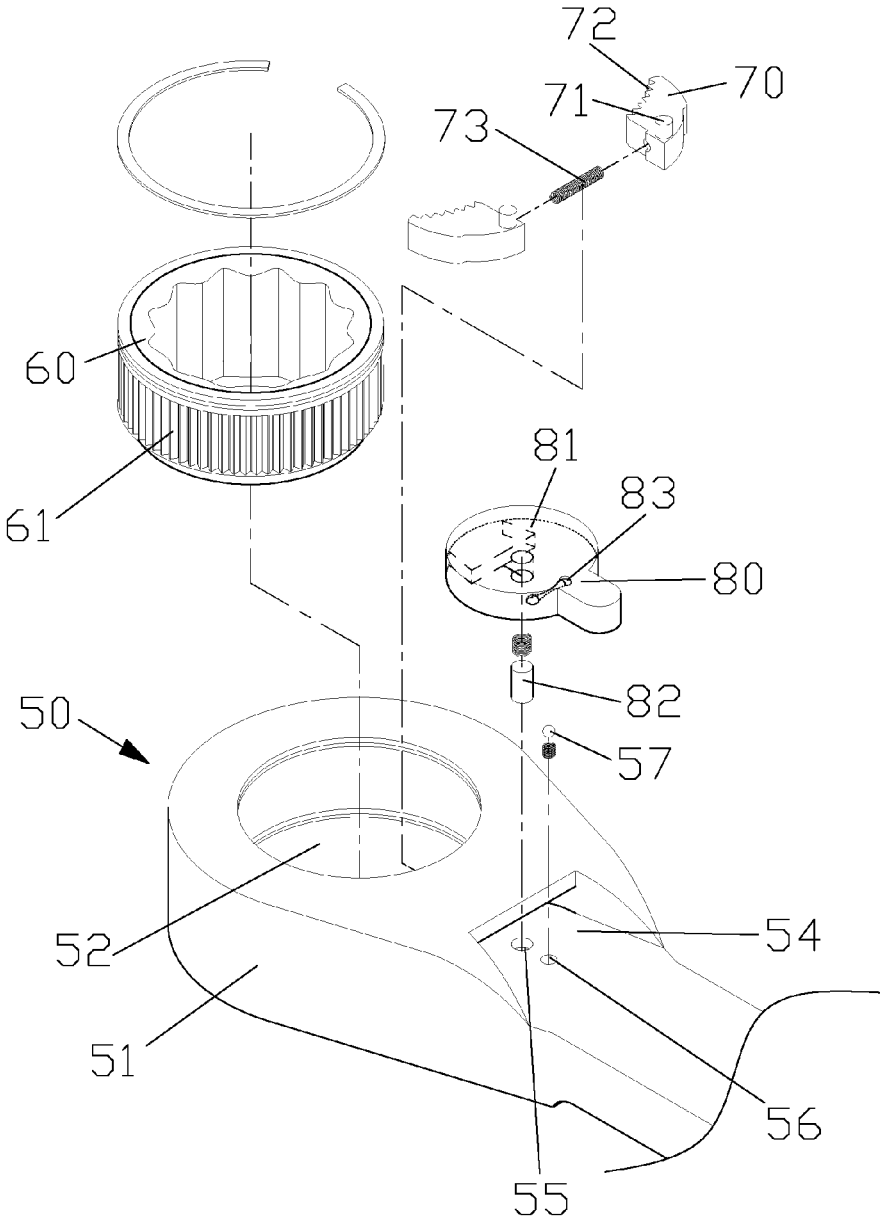
FIG. 12 is a perspective view showing the exploded components of the conventional positioning structure for the ratchet wrench.
Figure 13:
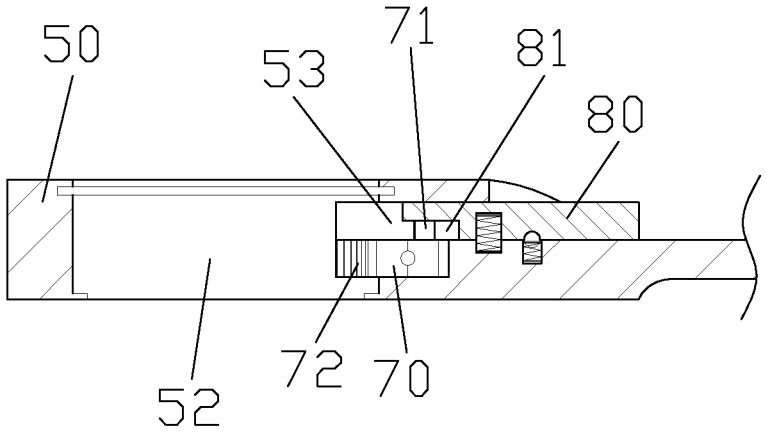
FIG. 13 is a cross sectional view showing the assembly of the conventional positioning structure for the ratchet wrench.
Figure 14:
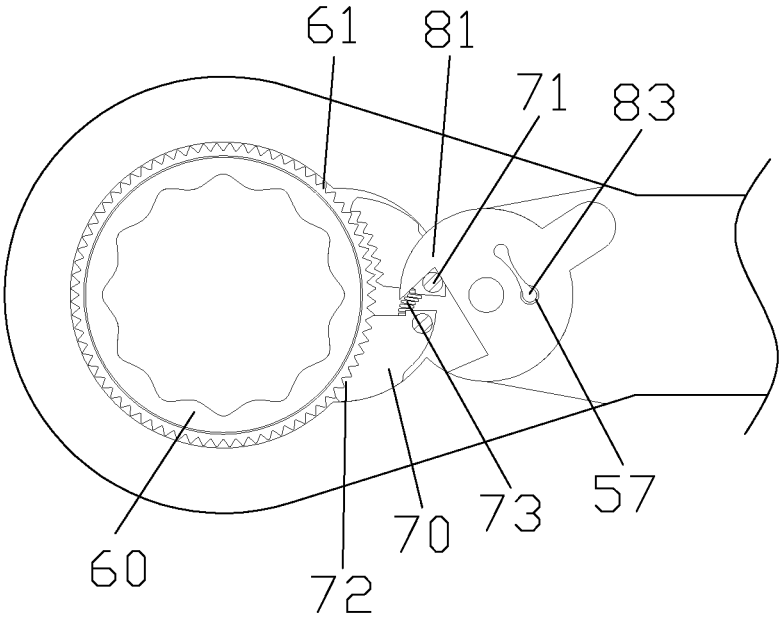
FIG. 14 is a cross sectional view showing the operation of the conventional positioning structure for the ratchet wrench.
Figure 15:
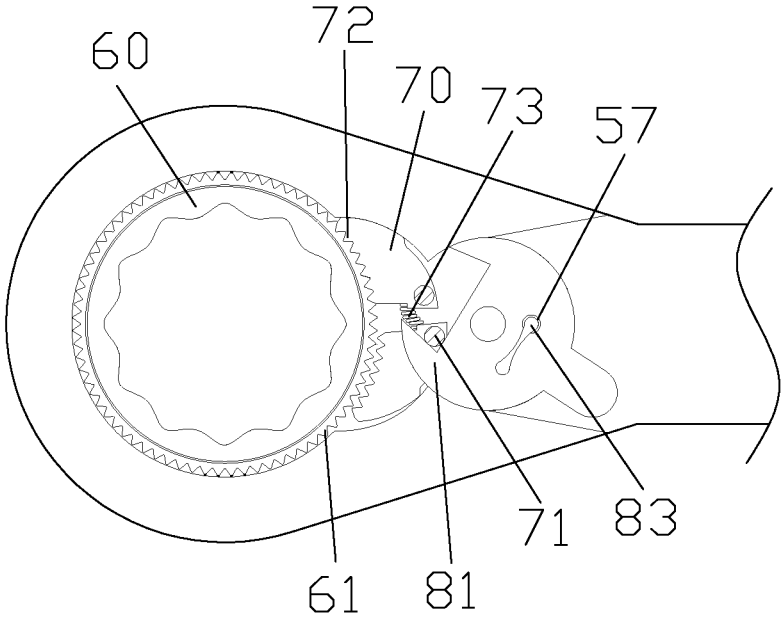
FIG. 15 is another cross sectional view showing the operation of the conventional positioning structure for the ratchet wrench.

Referring to FIGS. 1-3, a positioning structure for a ratchet wrench according to a first embodiment of the present invention comprises: a ratchet wrench 10 including a driving head 11, a receiving cavity 12 defined in a front end of the driving head 11, a first groove 13 formed behind and communicating with the receiving cavity 12, a second groove 14 formed behind the first groove 13 and in a rear end of the driving head 11, and a hole 15 arranged in the second groove 14. The receiving cavity 12 has a driving member 20 fixed therein, and the driving member 20 has a toothed portion 21 formed around an outer peripheral side thereof. The first groove 13 has two opposite retaining blocks 30 disposed therein, and each retaining block 30 has a plurality of locking teeth 33 arranged around a front end thereof so as to engage with the toothed portion 21 of the driving member 20. The each retaining block 30 also has an orifice 31 defined on a rear edge thereof and a receiving aperture 32 under the orifice 31. Between two receiving apertures 32 of the two retaining blocks 30 is defined a first resilient element 34. The second groove 14 has a directional control member 40 mounted therein. The directional control member 40 has a limiting portion 41, a recessed portion 42, an actuation portion 43, and a shaft 44, wherein a second resilient element 45 is fitted onto the shaft 44 and is inserted into the hole 15 of the second groove 14, and the actuation portion 43 is inserted into two orifices 31 of the two retaining blocks 30, such that the directional control member 40 is pushed upwardly by the second resilient element 45 so as to be shifted by a user to control an operational direction of the ratchet wrench 10, and the actuation portion 43 is limited in the two orifices 31 of the two retaining blocks 30 so as to further fix the directional control member 40 securely.

Referring further to FIGS. 3-6, the directional control member 40 is shifted in the second groove 14 so that the actuation portion 43 moves into one of the two orifices 31 to further drive one of the two retaining blocks 30, then the one of the two retaining blocks 30 moves backward and the first resilient element 34 presses another retaining block 30 to move frontward so that the another retaining block 30 engages with the toothed portion 21, thus changing an engaging direction of the two retaining blocks 30 and the driving member 20. In addition, the recessed portion 42 is used to prevent the directional control member 40 from overlapping with the two retaining blocks 30 during an operation of the directional control member 40. Also, the directional control member 40 is capable of controlling the driving member 20 to rotate in a clockwise direction or an anti-clockwise direction and to be positioned as well. Also, an engagement area of the plurality of locking teeth 33 and the working portion 21 is increased.

As shown in FIGS. 7-10, a difference of a positioning structure for a ratchet wrench of a second embodiment from that of the first embodiment comprises: each retaining block 30 has an extension 35 extending outwardly from a rear end thereof so that an orifice 31 is defined in the extension 35, and a decreased actuation portion 43 is arranged on a directional control member 40 so as to correspond to the orifice 31, thus reducing a size of the positioning structure.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A positioning structure for a ratchet wrench comprising:

a ratchet wrench including a driving head, a receiving cavity defined in a front end of the driving head, a first groove formed behind and communicating with the receiving cavity, a second groove formed behind the first groove and in a rear end of the driving head, and a hole arranged in the second groove;

the receiving cavity having a driving member fixed therein, and the driving member having a toothed portion formed around an outer peripheral side thereof;

the first groove having two opposite retaining blocks disposed therein, and each retaining block has a plurality of locking teeth arranged around a front end thereof so as to engage with the toothed portion of the driving member, the each retaining block also has an orifice defined on a rear edge thereof and a receiving aperture under the orifice, and between two receiving apertures of the two retaining blocks being defined a first resilient element;

the second groove having a directional control member mounted therein, the directional control member has a limiting portion, a recessed portion, an actuation portion, and a shaft, wherein a second resilient element is fitted onto the shaft and is inserted into the hole of the second groove, and the actuation portion is inserted into two orifices of the two retaining blocks.

2. The positioning structure for the ratchet wrench as claimed in claim 1, wherein the directional control member is pushed upwardly by the second resilient element so as to be shifted by a user to control an operational direction of the ratchet wrench.

3. The positioning structure for the ratchet wrench as claimed in claim 1, wherein the actuation portion is limited in the two orifices of the two retaining blocks so as to further fix the directional control member.

4. The positioning structure for the ratchet wrench as claimed in claim 1, wherein the directional control member does not overlap with the two retaining blocks by ways of the recessed portion.

5. The positioning structure for the ratchet wrench as claimed in claim 1, wherein the directional control member controls the driving member to rotate in a clockwise direction or an anti-clockwise direction and to be positioned.

6. The positioning structure for the ratchet wrench as claimed in claim 1, wherein the each retaining block has an extension extending outwardly from a rear end thereof so that an orifice is defined in the extension, and the actuation portion is decreased so as to correspond to the orifice.

* * * * *